US011142988B2

(12) United States Patent
Corre et al.

(10) Patent No.: US 11,142,988 B2
(45) Date of Patent: Oct. 12, 2021

(54) STRESS TESTING WITH INFLATABLE PACKER ASSEMBLY

(71) Applicant: Schlumberger Technology Corporation, Sugar Land, TX (US)

(72) Inventors: Pierre-Yves Corre, Abbeville (FR); Patrice Milh, Clamart (FR); Stephane Briquet, Paris (FR)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 11 days.

(21) Appl. No.: 16/652,132

(22) PCT Filed: Sep. 29, 2017

(86) PCT No.: PCT/IB2017/001349
§ 371 (c)(1),
(2) Date: Mar. 30, 2020

(87) PCT Pub. No.: WO2019/064041
PCT Pub. Date: Apr. 4, 2019

(65) Prior Publication Data
US 2020/0248524 A1 Aug. 6, 2020

(51) Int. Cl.
*E21B 33/127* (2006.01)
*E21B 33/124* (2006.01)
(Continued)

(52) U.S. Cl.
CPC ..... *E21B 33/127* (2013.01); *E21B 34/06* (2013.01); *E21B 43/26* (2013.01); *E21B 47/06* (2013.01)

(58) Field of Classification Search
CPC ..... E21B 43/26; E21B 33/124; E21B 33/127; E21B 33/1243; E21B 33/1272; E21B 33/1246; E21B 33/1277; E21B 34/14
See application file for complete search history.

(56) References Cited

U.S. PATENT DOCUMENTS 2,824,612 A * 2/1958 Lynes ..... E21B 33/1243 166/147
2,831,541 A * 4/1958 Conover ..... E21B 33/1243 166/147

(Continued)

OTHER PUBLICATIONS

International Search Report and Written Opinion issued in the counterpart PCT application PCT/IB2017/001349, dated Jun. 6, 2018 (13 pages).

(Continued)

*Primary Examiner* — Kenneth L Thompson
(74) *Attorney, Agent, or Firm* — Trevor G. Grove

(57) ABSTRACT

An inflatable packer assembly comprising a first fixed sleeve fixed to a mandrel, a first sliding sleeve moveable along the mandrel, and a first inflatable member connected to the first fixed sleeve and the first sliding sleeve. A second sliding sleeve is moveable along the mandrel, and a second inflatable member is connected to the first sliding sleeve and the second sliding sleeve. A second fixed sleeve is fixed to the mandrel and slidably engages the second sliding sleeve. An inflation flowline disposed within the mandrel is in fluid communication with interiors of the first and second inflatable members for inflating the first and second inflatable members to isolate a portion of a wellbore penetrating a subterranean formation. An injection flowline is disposed within the mandrel for injecting a fluid into the isolated wellbore portion at a high enough pressure to create microfractures in the subterranean formation.

20 Claims, 6 Drawing Sheets

(51) Int. Cl.

| | |
|---|---|
| ***E21B 34/14*** | (2006.01) |
| ***E21B 43/26*** | (2006.01) |
| ***E21B 34/06*** | (2006.01) |
| ***E21B 47/06*** | (2012.01) |

(56) References Cited

U.S. PATENT DOCUMENTS

| | | | | |
|---|---|---|---|---|
| 3,291,219 | A | 12/1966 | Nutter | |
| 4,357,992 | A * | 11/1982 | Sweeney | E21B 33/072 166/187 |
| 4,815,538 | A * | 3/1989 | Burroughs | E21B 33/1243 166/186 |
| 6,286,603 | B1 * | 9/2001 | Parent | E21B 33/1208 166/187 |
| 9,366,107 | B2 * | 6/2016 | Hallundb.ae butted.k | E21B 34/12 |
| 2006/0090905 | A1 | 5/2006 | Brennan et al. | |

OTHER PUBLICATIONS

International Preliminary Report on Patentability issued in the PCT application PCT/IB2017/001349, dated Apr. 9, 2020 (8 pages).

* cited by examiner

STRESS TESTING WITH INFLATABLE PACKER ASSEMBLY

BACKGROUND OF THE DISCLOSURE

Knowledge of in situ or downhole stresses may be utilized for analyzing various parameters related to rock mechanics. Rock mechanics may affect, among other things, hydrocarbon production rates, well stability, sand control, and/or horizontal well planning. Downhole formation stress information determined during geological formation exploration (e.g., during a wireline testing process and/or during a logging-while-drilling (LWD) process) may be used to, for example, design, select, and/or identify fracturing treatments used to increase hydrocarbon production.

SUMMARY OF THE DISCLOSURE

This summary is provided to introduce a selection of concepts that are further described below in the detailed description. This summary is not intended to identify indispensable features of the claimed subject matter, nor is it intended for use as an aid in limiting the scope of the claimed subject matter.

The present disclosure introduces an apparatus including an inflatable packer assembly for use in a wellbore penetrating a subterranean formation. The inflatable packer assembly includes a first fixed sleeve fixed to a mandrel, a first sliding sleeve moveable along the mandrel, and a first inflatable member connected to the first fixed sleeve and the first sliding sleeve. A second sliding sleeve is moveable along the mandrel. A second inflatable member is connected to the first sliding sleeve and the second sliding sleeve. A second fixed sleeve is fixed to the mandrel and slidably engages the second sliding sleeve. An inflation flowline is disposed within the mandrel and in fluid communication with interiors of the first and second inflatable members for inflating the first and second inflatable members to isolate a portion of the wellbore. An injection flowline is disposed within the mandrel for injecting a fluid into the isolated wellbore portion at a high enough pressure to create microfractures in the subterranean formation.

The present disclosure also introduces an apparatus including an inflatable packer assembly for use in a wellbore penetrating a subterranean formation. The inflatable packer assembly includes a first fixed sleeve fixed to a mandrel, a first sliding sleeve moveable along the mandrel, and a first inflatable member connected to the first fixed sleeve and the first sliding sleeve. A second sliding sleeve is moveable along the mandrel. A second inflatable member is connected to the first sliding sleeve and the second sliding sleeve. A third sliding sleeve is moveable along the mandrel. A third inflatable member is connected to the second sliding sleeve and the third sliding sleeve. A second fixed sleeve is fixed to the mandrel and slidably engages the third sliding sleeve. A first inflation flowline is disposed within the mandrel for inflating the first and third inflatable members to a first pressure. A second inflation flowline is disposed within the mandrel for inflating the second inflatable member to a second pressure greater than the first pressure. The inflated first, second, and third inflatable members isolate first and second portions of the wellbore. An injection flowline is disposed within the mandrel for injecting a fluid into at least one of the first and second isolated wellbore portions at a high enough pressure to enlarge microfractures in the subterranean formation.

The present disclosure also introduces a method that includes conveying an inflatable packer assembly (IPA) in a wellbore such that first and second inflatable members of the IPA straddle at least a portion of a zone of interest of a subterranean formation penetrated by the wellbore. The first and second inflatable members are inflated to radially expand the first and second inflatable members into sealing engagement with a wall of the wellbore and thereby isolate a portion of the wellbore. The first inflatable member extends between a fixed sleeve of the IPA and a first sliding sleeve of the IPA. The second inflatable member extends between the first sliding sleeve and a second sliding sleeve of the IPA, such that inflating the first and second inflatable members moves the first sliding sleeve closer to the fixed sleeve and moves the second sliding sleeve closer to the fixed sleeve and the first sliding sleeve. Fluid is injected into the isolated wellbore portion through a port of the first sliding sleeve to create or enlarge microfractures in the subterranean formation zone of interest. After stopping the fluid injection, pressure in the isolated wellbore portion is monitored to determine a closing pressure of the microfractures.

These and additional aspects of the present disclosure are set forth in the description that follows, and/or may be learned by a person having ordinary skill in the art by reading the material herein and/or practicing the principles described herein. At least some aspects of the present disclosure may be achieved via means recited in the attached claims.

BRIEF DESCRIPTION OF THE DRAWINGS

The present disclosure is understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
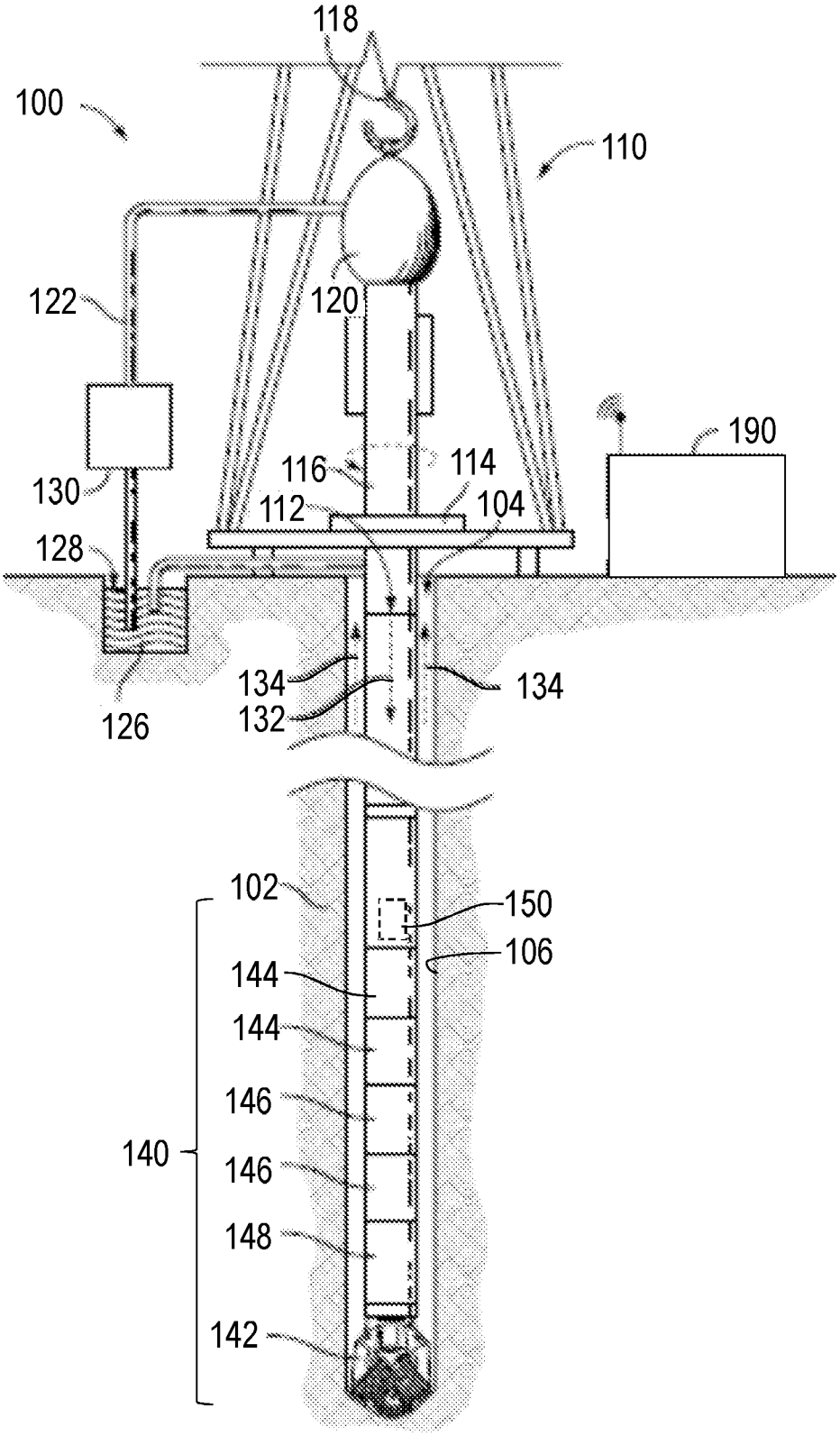
FIG. 1 is a schematic view of at least a portion of an example implementation of apparatus according to one or more aspects of the present disclosure.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for simplicity and clarity, and does not in itself dictate a relationship between the various embodiments and/or configurations discussed. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact.

One or more aspects of the present disclosure relate to stress test operations in which small-scale hydraulic fracturing techniques (such as those commonly known as "microfrac" or "minifrac") may be utilized for measuring downhole geological formation stresses, such as for measuring the minimum principal stress of the formation. Stress test operations according to one or more aspects of the present disclosure may be used to analyze fluid leak-off behavior, permeability, porosity, pore pressure, fracture closure pressure, fracture volume, and/or other example reservoir properties also within the scope of the present disclosure. The stress test operations may be performed during a drilling operation, or the drilling tool/string may be removed and a wireline tool deployed into the wellbore to test and/or measure the formation.

In an example stress test operation, a fluid is injected into a defined interval to create a test fracture in a geological formation. The fractured formation is then monitored by pressure measurements. The stress test operation may be performed using little or no proppant in the fracturing fluid. After the fracturing fluid is injected and the formation is fractured, the well may be shut-in, and the pressure decline of the fluid in the newly formed fracture may be observed as a function of time. The data thus obtained may be used to determine parameters for designing a subsequent, full-scale formation fracturing treatment. Conducting stress test operations before performing the full-scale treatment may result in improved fracture treatment design, such as may yield in enhanced production and improved economics from the fractured formation.

Stress test operations are significantly different from conventional full-scale fracturing operations. For example, as described above, just a small amount of fracturing fluid is injected for stress test operations, and little or no proppant may be carried with the fracturing fluid. The fracturing fluid used for stress test operations may be of the same type that will be used for the subsequent full-scale treatment. The intended result is not a propped fracture practical for production, but a small fracture to facilitate collection of pressure data from which formation and fracture parameters can be estimated and/or otherwise determined. The pressure decline data may be utilized to calculate the effective fluid loss coefficient of the fracture fluid, fracture width, fracture length, efficiency of the fracture fluid, and the fracture closure time, for example. These parameters may then be utilized in, for example, a fracture design simulator to establish parameters for performing the full-scale fracturing operation.

The pressures utilized in stress test operations may exceed the axial force limitations of conventional downhole tools used for stress test operations. One or more aspects of the present disclosure pertain to a downhole tool comprising an inflatable packer assembly that is capable of withstanding high-pressure stress test operations.

FIG. 1 is a schematic view of an example wellsite system 100 to which one or more aspects of the present disclosure may be applicable. The wellsite system 100 may be onshore or offshore. In the example wellsite system 100 shown in FIG. 1, a wellbore 104 is formed in one or more subterranean formation 102 by rotary drilling. Other example systems within the scope of the present disclosure may also or instead utilize directional drilling. While some elements of the wellsite system 100 are depicted in FIG. 1 and described below, it is to be understood that the wellsite system 100 may include other components in addition to, or in place of, those presently illustrated and described.

As shown in FIG. 1, a drillstring 112 suspended within the wellbore 104 comprises a bottom hole assembly (BHA) 140 that includes or is coupled with a drill bit 142 at its lower end. The surface system includes a platform and derrick assembly 110 positioned over the wellbore 104. The platform and derrick assembly 110 may comprise a rotary table 114, a kelly 116, a hook 118, and a rotary swivel 120. The drillstring 112 may be suspended from a lifting gear (not shown) via the hook 118, with the lifting gear being coupled to a mast (not shown) rising above the surface. An example lifting gear includes a crown block affixed to the top of the mast, a vertically traveling block to which the hook 118 is attached, and a cable passing through the crown block and the vertically traveling block. In such an example, one end of the cable is affixed to an anchor point, whereas the other end is affixed to a winch to raise and lower the hook 118 and the drillstring 112 coupled thereto. The drillstring 112 comprises one or more types of tubular members, such as drill pipes, threadedly attached one to another, perhaps including wired drilled pipe.

The drillstring 112 may be rotated by the rotary table 114, which engages the kelly 116 at the upper end of the drillstring 112. The drillstring 112 is suspended from the hook 118 in a manner permitting rotation of the drillstring 112 relative to the hook 118. Other example wellsite systems within the scope of the present disclosure may utilize a top drive system to suspend and rotate the drillstring 112, whether in addition to or instead of the illustrated rotary table system.

The surface system may further include drilling fluid or mud 126 stored in a pit or other container 128 formed at the wellsite. The drilling fluid 126 may be oil-based mud (OBM) or water-based mud (WBM). A pump 130 delivers the drilling fluid 126 to the interior of the drillstring 112 via a hose or other conduit 122 coupled to a port in the rotary swivel 120, causing the drilling fluid to flow downward through the drillstring 112, as indicated in FIG. 1 by directional arrow 132. The drilling fluid exits the drillstring 112 via ports in the drill bit 142, and then circulates upward through the annulus region between the outside of the drillstring 112 and the wall 106 of the wellbore 104, as indicated in FIG. 1 by directional arrows 134. In this manner, the drilling fluid 126 lubricates the drill bit 142 and carries formation cuttings up to the surface as it is returned to the container 128 for recirculation.

The BHA 140 may comprise one or more specially made drill collars near the drill bit 142. Each such drill collar may comprise one or more devices permitting measurement of downhole drilling conditions and/or various characteristic properties of the subterranean formation 102 intersected by the wellbore 104. For example, the BHA 140 may comprise one or more logging-while-drilling (LWD) modules 144, one or more measurement-while-drilling (MWD) modules 146, a rotary-steerable system and motor 148, and perhaps the drill bit 142. Other BHA components, modules, and/or tools are also within the scope of the present disclosure, and such other BHA components, modules, and/or tools may be positioned differently in the BHA 140.

The LWD modules 144 may comprise an inflatable packer assembly (IPA) for performing stress test operations as described above. Example aspects of such IPA tools are described below. Other examples of the LWD modules 144 are also within the scope of the present disclosure.

The MWD modules 146 may comprise one or more devices for measuring characteristics of the drillstring 112 and/or the drill bit 142, such as for measuring weight-on-bit, torque, vibration, shock, stick slip, tool face direction, and/or inclination, among others. The MWD modules 146 may further comprise an apparatus (not shown) for generating electrical power to be utilized by the downhole system. This may include a mud turbine generator powered by the flow of the drilling fluid 126. Other power and/or battery systems may also or instead be employed.

The wellsite system 100 also includes a data processing system that can include one or more, or portions thereof, of the following: the surface equipment 190, control devices and electronics in one or more modules of the BHA 140 (such as a downhole controller 150), a remote computer system (not shown), communication equipment, and other equipment. The data processing system may include one or more computer systems or devices and/or may be a distributed computer system. For example, collected data or information may be stored, distributed, communicated to an operator, and/or processed locally or remotely.

The data processing system may, individually or in combination with other system components, perform the methods and/or processes described below, or portions thereof. For example, such data processing system may include processor capability for collecting data relating to the pressure decay measured during stress test operations in conjunction with an IPA tool of the LWD modules 144. Methods and/or processes within the scope of the present disclosure may be implemented by one or more computer programs that run in a processor located, for example, in one or more modules of the BHA 140 and/or the surface equipment 190. Such programs may utilize data received from the BHA 140 via mud-pulse telemetry and/or other telemetry means, and/or may transmit control signals to operative elements of the BHA 140. The programs may be stored on a tangible, non-transitory, computer-usable storage medium associated with the one or more processors of the BHA 140 and/or surface equipment 190, or may be stored on an external, tangible, non-transitory, computer-usable storage medium that is electronically coupled to such processor(s). The storage medium may be one or more known or future-developed storage media, such as a magnetic disk, an optically readable disk, flash memory, or a readable device of another kind, including a remote storage device coupled over a communication link, among other examples.

Figure 2:
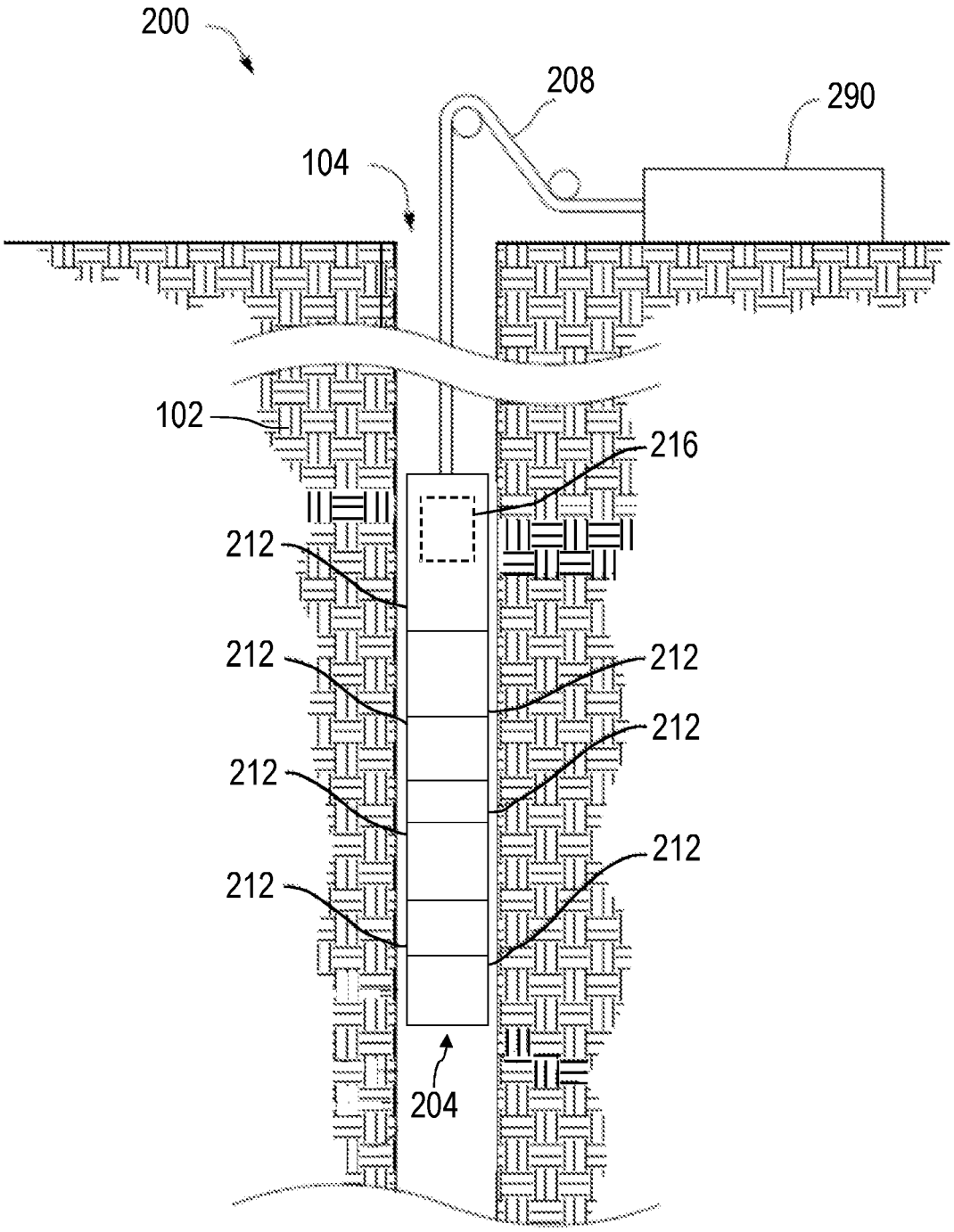
FIG. 2 is a schematic view of at least a portion of an example implementation of apparatus according to one or more aspects of the present disclosure.

FIG. 2 is a schematic view of another example wellsite system 200 to which one or more aspects of the present disclosure may be applicable. The wellsite system 200 may be onshore or offshore. In the example wellsite system 200 shown in FIG. 2, a tool string 204 is conveyed into the wellbore 104 via a wireline and/or other conveyance means 208. As with the wellsite system 100 shown in FIG. 1, the example wellsite system 200 of FIG. 2 may be utilized for stress test operations according to one or more aspects of the present disclosure.

The tool string 204 is suspended in the wellbore 104 from the lower end of the wireline 208, which may be a multi-conductor logging cable spooled on a winch (not shown). The wireline 208 may include at least one conductor that facilitates data communication between the tool string 204 and surface equipment 290 disposed on the surface. The surface equipment 290 may have one or more aspects in common with the surface equipment 190 shown in FIG. 1.

The tool string 204 and wireline 208 may be structured and arranged with respect to a service vehicle (not shown) at the wellsite. For example, the wireline 208 may be connected to a drum (not shown) at the wellsite surface, wherein rotation of the drum raises and lowers the tool string 204 within the wellbore 104. The drum may be disposed on a service truck or a stationary platform. The service truck or stationary platform may further contain the surface equipment 290.

The tool string 204 comprises one or more tools and/or modules schematically represented in FIG. 2. For example, the illustrated tool string 204 includes several modules 212, at least one of which may be or comprise at least a portion of an IPA tool as described below. Other implementations of the downhole tool string 204 within the scope of the present disclosure may include additional or fewer components or modules relative to the example implementation depicted in FIG. 2.

The wellsite system 200 also includes a data processing system that can include one or more of, or portions of, the following: the surface equipment 290, control devices and electronics in one or more modules of the tool string 204 (such as a downhole controller 216), a remote computer system (not shown), communication equipment, and other equipment. The data processing system may include one or more computer systems or devices and/or may be a distributed computer system. For example, collected data or information may be stored, distributed, communicated to an operator, and/or processed locally or remotely.

The data processing system may, individually or in combination with other system components, perform the methods and/or processes described below, or portions thereof. For example, such data processing system may include processor capability for collecting data relating during stress test operations according to one or more aspects of the present disclosure. Methods and/or processes within the scope of the present disclosure may be implemented by one or more computer programs that run in a processor located, for example, in one or more modules 212 of the tool string 204 and/or the surface equipment 290. Such programs may utilize data received from the downhole controller 216 and/or other modules 212 via the wireline 208, and may transmit control signals to operative elements of the tool string 204. The programs may be stored on a tangible, non-transitory, computer-usable storage medium associated with the one or more processors of the downhole controller 216, other modules 212 of the tool string 204, and/or the surface equipment 290, or may be stored on an external, tangible, non-transitory, computer-usable storage medium that is electronically coupled to such processor(s). The storage medium may be one or more known or future-developed storage media, such as a magnetic disk, an optically readable disk, flash memory, or a readable device of another kind, including a remote storage device coupled over a communication link, among other examples.

While FIGS. 1 and 2 illustrate example wellsite systems 100 and 200, respectively, that convey a downhole tool/string into a wellbore, other example implementations consistent with the scope of this disclosure may utilize other conveyance means to convey a tool into a wellbore, including coiled tubing, tough logging conditions (TLC), slickline, and others. Additionally, other downhole tools within the scope of the present disclosure may comprise components in a non-modular construction also consistent with the scope of this disclosure.

Figure 3:
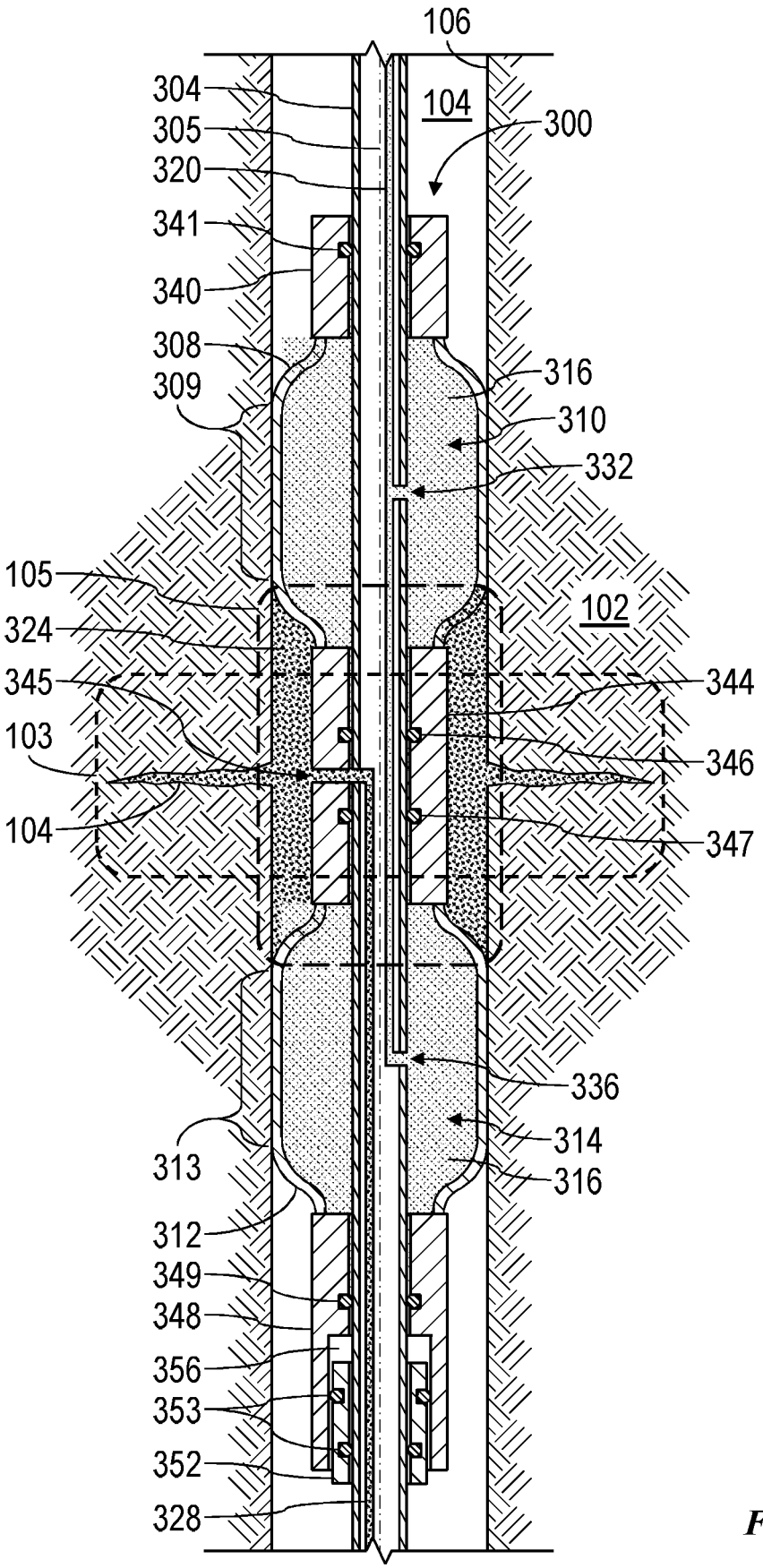
FIG. 3 is a schematic view of at least a portion of an example implementation of apparatus according to one or more aspects of the present disclosure.

FIG. 3 is a schematic view of at least a portion of an example implementation of an inflatable packer assembly (IPA) 300 according to one or more aspects of the present disclosure. The IPA 30 is depicted in FIG. 1 in a "dual-packer arrangement," although other implementations are also within the scope of the present disclosure. The IPA 300 is for use in a wellbore 104 penetrating a subterranean formation 102, whether via the drill string 112 depicted in FIG. 1, the wireline 208 depicted in FIG. 2, and/or other conveyance means within the scope of the present disclosure.

The IPA 300 includes a mandrel 304, an uphole (hereafter "upper") inflatable member 308, and a downhole (hereafter "lower") inflatable member 312 spaced apart from the upper inflatable member 308 along a longitudinal axis 305 of the mandrel 304. The upper and lower inflatable members 308, 312 extend circumferentially around the mandrel 304. The axial separation between the inflatable members 308, 312 may range between about one meter (m) and about 30 m. However, other distances are also within the scope of the present disclosure. The inflatable members 308, 312 may be made of various materials suitable for forming a seal with the wall 106 of the wellbore 104. For example, the inflatable members 308, 312 may be made of rubber and/or other viscoelastic materials.

As shown in FIG. 3, the inflatable members 308, 312 inflate to fluidly isolate a portion 105 of the wellbore 104 that straddles or otherwise coincides with at least a portion of a zone of interest 103 in the formation 102. To inflate the inflatable members 308, 312 into sealing engagement with the wellbore wall 106, the inflatable members 308, 312 may be filled with an inflation fluid 316 via an inflation flowline 320, thus radially expanding the inflatable members 308, 312 until substantial portions 309, 313 contact and seal against the wellbore wall 106. The inflation fluid 316 may be or comprise fluid obtained from the wellbore 104, hydraulic fluid carried with or pumped to the IPA 300, and/or other substantially incompressible fluids.

When the inflatable members 308, 312 are inflated, the IPA 300 may be operated to inject a fluid 324 from an injection flowline 328 into the isolated wellbore portion 105, such as for stress testing the formation 102 within the zone of interest 103. The injected fluid 324 may be injected into the isolated wellbore portion 105 at a pressure that is high enough to create microfractures 104 in the formation 102. The injected fluid 324 may be or comprise fluid obtained from the wellbore 104, fracturing fluid and/or other hydraulic fluid carried with or pumped to the IPA 300, and/or other substantially incompressible fluids.

The mandrel 304 may be a single, discrete member or multiple connected members, each formed of a rigid material such as carbon or alloy steel. The mandrel 304 may be generally cylindrical in shape, and may not include internally moving components. The mandrel 304 may be substantially solid, having passages drilled or otherwise formed to create the inflation flowline 320 and the injection flowline 328. However, at least a portion of the mandrel 304 may be substantially hollow, and the flowlines 320, 328 may each be or comprise one or more tubes and/or other conduits for transmitting the inflation and injected fluids 316, 324.

The inflation flowline 320 may comprise or be in selective or constant fluid communication with an upper inflation port 332 for pressurizing and depressurizing the upper inflatable member 308, and a lower inflation port 336 for pressurizing and depressurizing the lower inflatable member 312. A pump (not shown) may be used to conduct the inflation fluid 316 into and/or otherwise pressurize the inflation flowline 320 and thereby independently or simultaneously inflate the upper and/or lower inflatable members 308, 312 via the ports 332, 336. For example, the upper and lower inflatable members 308, 312 may be pressurized to about 1,000 pounds per square inch (psi) in a wellbore having a diameter of about 21.6 centimeters (cm). The term "depressurizing" as used herein may include releasing pressure from the inflation flowline 320 by, for example, controlling the pressure exerted by the pump (not shown), and may also include actively removing pressure from the inflation flowline 320.

The injection flowline 328 may comprise or be in selective or constant fluid communication with an injection port 345 between the upper and lower inflatable members 308, 312 for injecting the fluid 324 into the isolated wellbore portion 105, such as for stress testing the formation 102 as described herein. A high-pressure pump (not shown) may be used to conduct the injection fluid 324 into and/or otherwise pressurize the injection flowline 328 to inject the fluid 324 into the isolated wellbore portion 105, perhaps at a pressure high enough to create the microfractures 104 within the zone of interest 106 between the upper and lower inflatable members 308, 312.

For example, the fluid 324 may be injected until hydraulic pressure in the zone of interest 103 increases to reach an initial fracturing pressure, such that microfractures 104 are formed in the formation 102 near the wellbore wall 106. The microfractures 104 may range in length between about 10 cm and about 100 cm, and may have openings (near the wellbore wall 106) ranging between about 3 mm and about 15 mm. When the injected fluid 324 is further injected, the microfractures 104 gradually widen, thus lowering pressure in the isolated wellbore portion 105. When the injection is stopped, the microfractures 104 close and the pressure reaches fracture closing pressure. The fracture closure pressure is equal to or slightly greater than the pressure sufficient to keep the microfractures 104 open, and thus represents the minimum principal stress, which acts in a direction perpendicular to the fractured surface. The injection and bleed-off process may also be repeated, thus reopening the microfractures 104 at a fracture reopening pressure. The maximum horizontal principal stress may be determined using the measured fracture reopening pressure.

The construction and configuration of the IPA 300 may permit fluid 324 to be injected into the formation 102 at a hydraulic pressure of about 12,000 psi in a wellbore 104 having a diameter of about 21.6 cm. However, other injection pressures are also within the scope of the present disclosure.

An upper end of the upper inflatable member 308 is connected to an upper fixed sleeve 340, and a lower end of the upper inflatable member 308 is connected to an intermediate sliding sleeve 344. An upper end of the lower inflatable member 312 is connected to the intermediate sliding sleeve 344, and a lower end of the lower inflatable member 312 is connected to a lower sliding sleeve 348. The upper fixed sleeve 340 is attached to or otherwise fixed with respect to the mandrel 304. The intermediate sliding sleeve 344 is moveable along the mandrel 304. The lower sliding sleeve 348 is moveable along the mandrel 304 and a lower fixed sleeve 352. The lower fixed sleeve 352 is attached to or otherwise fixed with respect to the mandrel 304.

The upper fixed sleeve 340 includes at least one seal 341 preventing fluid communication between the wellbore 104 and the interior 310 of the upper inflatable member 308. The intermediate sliding sleeve 344 includes a port 345 in selective or continuous fluid communication with the isolated wellbore portion 105 for communicating the injected fluid 324 into the isolated wellbore portion 105 and the formation zone of interest 103. The intermediate sliding sleeve 344 also includes sliding seals 346, 347 preventing fluid communication between the isolated wellbore portion 105 and the interiors 310, 314 of the respective upper and lower inflatable members 308, 312. The lower sliding sleeve 348 includes a sliding seal 349 preventing fluid communication between the interior 314 of the lower inflatable member 312 and a changing volume 356 defined between the lower sliding sleeve 348 and the lower fixed sleeve 352. The lower fixed sleeve 352 includes at least one seal 353 (two being depicted in FIG. 3) preventing fluid communication between the volume 356 and the wellbore 104.

In operation, while the upper and lower inflatable members 308, 312 are deflated, the IPA 300 is conveyed within the wellbore 104 until the IPA 300 is proximate the zone of interest 103 in the formation 102, such as to a depth at which the upper and lower inflatable members 308, 312 straddle the zone of interest 103 and the injection port 345 is within the zone of interest 31. The upper and lower inflatable members 308, 312 are then inflated, as described above, such that the upper and lower inflatable members 308, 312 radially expand into sealing engagement with the wellbore wall 106 and create the isolated portion 105 of the wellbore 104. Fluid 324 may then be injected through the port 345 at a high enough pressure to create microfractures 104 in the formation 102. The injection is then stopped, and the subsequently decreasing pressure in the isolated wellbore portion 105 is monitored (e.g., via measuring pressure in the injection flowline 328) to determine the fracture closing pressure and the minimum principal stress. The injection and bleed-off process may also be repeated to determine the fracture reopening pressure and the maximum horizontal principal stress. The upper and lower inflatable members 308, 312 may then be deflated for removal of the IPA 300 from the wellbore 104 or repositioning to another zone of interest for performing additional stress test operations.

In implementations in which the volume 356 is sealed, the movement of the lower sliding sleeve 348 away from the lower fixed sleeve 352 may create a decreased pressure in the volume 356. Consequently, as the upper and lower inflatable members 308, 312 are depressurized, the decreased pressure in the volume 356 may act to move the lower sliding sleeve 348 down towards its initial position. Thus, the lower sliding sleeve 348 and the lower fixed sleeve 352 may act as an auto-retract mechanism, operable to aid in retracting the upper and lower inflatable members 308, 312 closer to the mandrel 304, thereby reducing the overall diameter of the IPA 300 to aid in conveying the IPA 300 within the wellbore 104.

Figure 4:
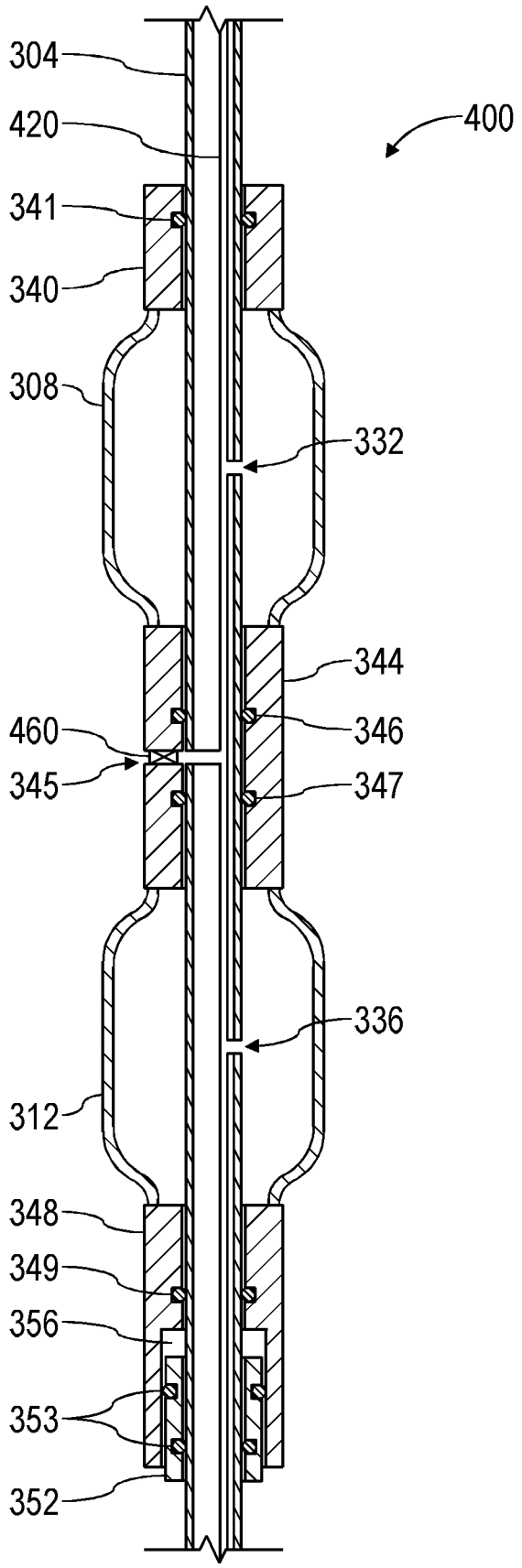
FIG. 4 is a schematic view of another example implementation of the apparatus shown in FIG. 3 according to one or more aspects of the present disclosure.

In FIG. 3, the inflation flowline 320 and the injection flowline 328 are shown as distinct flow paths. However, as illustrated in FIG. 4, the inflation and injection flowlines 320, 328 may share a common flow path 420. In such implementations, among others within the scope of the present disclosure, a valve 460 may be in fluid communication with the common flowline 420 to selectively control fluid communication with the wellbore. The valve 460 may permit fluid used to inflate the inflatable members 308, 312 to also be selectively injected into the isolated wellbore section via the port 345. For example, the valve 460 may be a relief valve that opens a predetermined differential pressure setting. The valve 460 may be controlled passively, actively, or by a preset relief pressure. For example, the relief pressure may be set at about 500 psi in wellbore having a diameter of about 21.6 cm. However, other set pressures are also within the scope of the present disclosure.

Figure 5:
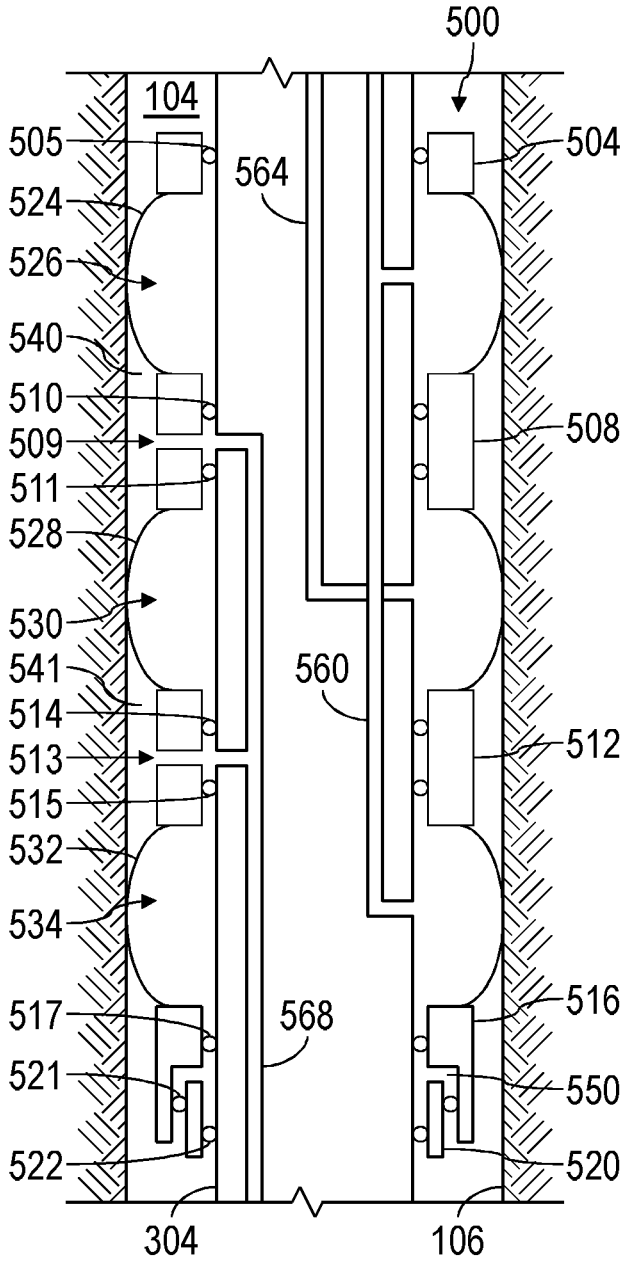
FIG. 5 is a schematic view of another example implementation of the apparatus shown in FIG. 3 according to one or more aspects of the present disclosure.

FIG. 5 is a schematic view of another implementation of the IPA 300 shown in FIG. 1, designated in FIG. 5 by reference number 500. The IPA 500 is shown as a "triple packer arrangement" for use in the wellbore 104 for testing the formation 102. The IPA 500 shown in FIG. 5 is substantially similar to the IPA shown in FIG. 3 except as described below.

The IPA 500 includes an upper fixed sleeve 504, an upper sliding sleeve 508, an intermediate sliding sleeve 512, a lower sliding sleeve 516, and a lower fixed sleeve 520. The upper fixed sleeve 504 is substantially similar to the upper sliding sleeve 340 shown in FIG. 3. The upper and intermediate sliding sleeves 508, 512 are each substantially similar to the intermediate sliding sleeve 344 shown in FIG. 3. The lower sliding sleeve 516 and the lower fixed sleeve 520 are substantially similar to the lower sliding sleeve 348 and the lower fixed sleeve 352, respectively, shown in FIG. 3.

An upper inflatable member 524 is connected to and extends between the upper fixed sleeve 504 and the upper sliding sleeve 508. An intermediate inflatable member 528 is connected to and extends between the upper sliding sleeve 508 and the intermediate sliding sleeve 512. When inflated, the upper and intermediate inflatable members 524, 528 fluidly isolate a portion 540 of the wellbore 104. A lower inflatable member 532 is connected to and extends between the intermediate sliding sleeve 512 and the lower sliding sleeve 516. When inflated, the intermediate and lower inflatable members 528, 532 fluidly isolate a portion 541 of the wellbore 104. The upper, intermediate, and lower inflatable members 524, 528, 532 are substantially similar to the upper and lower inflatable members 308, 312 shown in FIG. 3.

The upper fixed sleeve 504 is attached to or otherwise fixed with respect to the mandrel 304, and includes a seal 505 preventing fluid communication between the wellbore 104 and the interior 526 of the upper inflatable member 524. The upper sliding sleeve 508 slides along the mandrel 304, and may include an injection port 509 for injecting fluid into the isolated wellbore portion 540. The upper sliding sleeve 508 may also include a seal 510 preventing fluid communication between the isolated wellbore portion 540 and the interior 526 of the upper inflatable member 524, and a seal 511 preventing fluid communication between the isolated wellbore portion 540 and the interior 530 of the intermediate inflatable member 528. The intermediate sliding sleeve 512 also slides along the mandrel 304, and may include an injection port 513 for injecting fluid into the isolated wellbore portion 541. Just one or both of the upper and intermediate sliding sleeves 508, 512 may include the corresponding injection port 509, 513. The intermediate sliding sleeve 512 may also include a seal 514 preventing fluid communication between the isolated wellbore portion 541 and the interior 530 of the intermediate inflatable member 524, and a seal 515 preventing fluid communication between the isolated wellbore portion 541 and the interior 534 of the lower inflatable member 532.

The lower sliding sleeve 516 is moveable along the mandrel 304 and the lower fixed sleeve 520, and the lower fixed sleeve 520 is attached to or otherwise fixed with respect to the mandrel 304. A changing volume 550 substantially similar to the volume 356 shown in FIG. 3 may be defined between surfaces of the lower sliding sleeve 516, the lower fixed sleeve 520, the mandrel 304, and perhaps corresponding seals. For example, the lower sliding sleeve 516 may include a seal 517 preventing fluid communication between the volume 550 and the interior 534 of the lower inflatable member 532, and the lower fixed sleeve 520 may include one or more seals 521, 522 preventing fluid communication between the volume 550 and the wellbore 104.

The upper and lower ("outer") inflatable members 524, 532 are inflated and deflated via an outer packer inflation flowline 560, and the intermediate inflatable member 528 is inflated and deflated via an inner packer inflation flowline 564. In other implementations, the upper, intermediate, and lower inflatable members 524, 532 may be inflated and deflated via the flowline 560, and the intermediate inflatable member 528 may be further pressurized (beyond the pressurization of the outer inflatable members 524, 532) via the flowline 564. The inflation fluid may be as described above with respect to FIG. 3. Various valves and other circuitry (not shown) may be operable for the inflation and deflation of the inflatable members 524, 528, 532.

When the inflatable members 524, 528, 532 are inflated, the IPA 500 may be operated to inject a fluid from an injection flowline 568 into just one or both of the isolated wellbore portions 540, 541 via the respective port 509, 513, such as for stress testing the formation 102 within a zone of interest. The injected fluid may be injected into just one or both isolated wellbore portions 540, 541, perhaps at a pressure that is high enough to create microfractures in the formation 102, similar to as depicted in FIG. 3. The injection fluid may be as described above with respect to FIG. 3. Various valves and other circuitry (not shown) may be operable for injection via just one or both ports 509, 513.

In operation, while the inflatable members 524, 528, 532 are deflated, the IPA 500 is conveyed within the wellbore 104 until the IPA 500 is proximate a zone of interest in the formation 102. The inflatable members 524, 528, 532 are then inflated to a first pressure, as described above, such that the inflatable members 524, 528, 532 radially expand into sealing engagement with the wellbore wall 106 and create the isolated portions 540, 541 of the wellbore 104. The intermediate inflatable member 528 may then be further pressurized, such as to a fracturing pressure. Fluid may then be injected through just one or both ports 509, 513 at a high enough pressure to create microfractures in the formation. The injection is then stopped, and the subsequently decreasing pressure in one or both isolated wellbore portions 540, 541 is monitored (e.g., via measuring pressure in the injection flowline 568), such as to determine the fracture closing pressure and the minimum principal stress. The injection and bleed-off process may also be repeated to determine the fracture reopening pressure and the maximum horizontal principal stress. The inflatable members 524, 528, 532 may then be deflated for removal of the IPA 500 from the wellbore 104 or repositioning to another zone of interest for performing additional stress test operations.

In implementations in which the volume 550 is sealed, the movement of the lower sliding sleeve 516 away from the lower fixed sleeve 520 may create a decreased pressure in the volume 550. Consequently, as the inflatable members 524, 528, 532 are depressurized, the decreased pressure in the volume 550 may act to move the lower sliding sleeve 516 down towards its initial position. Thus, the lower sliding sleeve 516 and the lower fixed sleeve 520 may act as an auto-retract mechanism, operable to aid in retracting the inflatable members 524, 528, 532 closer to the mandrel 304, thereby reducing the overall diameter of the IPA 500 to aid in conveying the IPA 500 within the wellbore 104.

Figure 6:
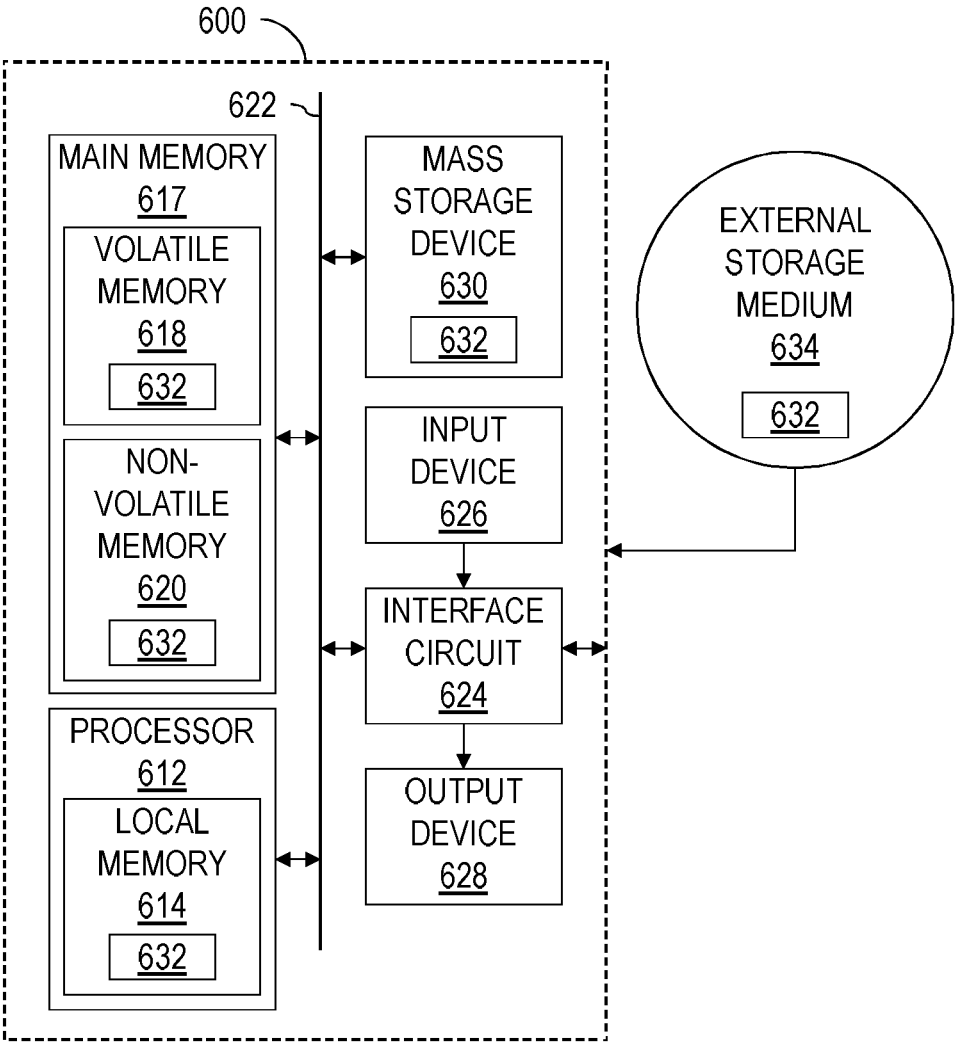
FIG. 6 is a schematic view of at least a portion of an example implementation of apparatus according to one or more aspects of the present disclosure.

The inflatable packer assemblies and methods in accordance with one or more aspects of the present disclosure may be utilized with a controller for controlling pump(s), sensors, actuation mechanisms, valves, and other mechanisms. FIG. 6 is a schematic view of at least a portion of an example implementation of a processing system 600 according to one or more aspects of the present disclosure. The processing system 600 may execute example machine-readable instructions to implement at least a portion of one or more of the methods and/or processes described herein, and/or to implement a portion of one or more of the example downhole tools described herein. The processing system 600 may be or comprise, for example, one or more processors, controllers, special-purpose computing devices, servers, personal computers, personal digital assistant (PDA) devices, smartphones, internet appliances, and/or other types of computing devices. Moreover, while it is possible that the entirety of the processing system 600 shown in FIG. 6 is implemented within downhole apparatus described above, one or more components or functions of the processing system 600 may also or instead be implemented in wellsite surface equipment, perhaps including the surface equipment 190 depicted in FIG. 1, the surface equipment 290 depicted in FIG. 2, and/or other surface equipment.

The processing system 600 may comprise a processor 612, such as a general-purpose programmable processor, for example. The processor 612 may comprise a local memory 614, and may execute program code instructions 632 present in the local memory 614 and/or another memory device. The processor 612 may execute, among other things, machine-readable instructions or programs to implement the methods and/or processes described herein. The programs stored in the local memory 614 may include program instructions or computer program code that, when executed by an associated processor, cause a controller and/or control system implemented in surface equipment and/or a downhole tool to perform tasks as described herein. The processor 612 may be, comprise, or be implemented by one or more processors of various types operable in the local application environment, and may include one or more general-purpose processors, special-purpose processors, microprocessors, digital signal processors (DSPs), field-programmable gate arrays (FPGAs), application-specific integrated circuits (ASICs), processors based on a multi-core processor architecture, and/or other processors.

The processor 612 may be in communication with a main memory 617, such as via a bus 622 and/or other communication means. The main memory 617 may comprise a volatile memory 618 and a non-volatile memory 620. The volatile memory 618 may be, comprise, or be implemented by random access memory (RAM), static random access memory (SRAM), synchronous dynamic random access memory (SDRAM), dynamic random access memory (DRAM), RAMBUS dynamic random access memory (RDRAM), and/or other types of random access memory devices. The non-volatile memory 620 may be, comprise, or be implemented by read-only memory, flash memory, and/or other types of memory devices. One or more memory controllers (not shown) may control access to the volatile memory 618 and/or the non-volatile memory 620.

The processing system 600 may also comprise an interface circuit 624. The interface circuit 624 may be, comprise, or be implemented by various types of standard interfaces, such as an Ethernet interface, a universal serial bus (USB), a third generation input/output (3GIO) interface, a wireless interface, and/or a cellular interface, among other examples. The interface circuit 624 may also comprise a graphics driver card. The interface circuit 624 may also comprise a communication device, such as a modem or network interface card, to facilitate exchange of data with external computing devices via a network, such as via Ethernet connection, digital subscriber line (DSL), telephone line, coaxial cable, cellular telephone system, and/or satellite, among other examples.

One or more input devices 626 may be connected to the interface circuit 624. One or more of the input devices 626 may permit a user to enter data and/or commands for utilization by the processor 612. Each input device 626 may be, comprise, or be implemented by a keyboard, a mouse, a touchscreen, a track-pad, a trackball, an image/code scanner, and/or a voice recognition system, among other examples.

One or more output devices 628 may also be connected to the interface circuit 624. One or more of the output devices 628 may be, comprise, or be implemented by a display device, such as a liquid crystal display (LCD), a light-emitting diode (LED) display, and/or a cathode ray tube (CRT) display, among other examples. One or more of the output devices 628 may also or instead be, comprise, or be implemented by a printer, speaker, and/or other examples.

The processing system 600 may also comprise a mass storage device 630 for storing machine-readable instructions and data. The mass storage device 630 may be connected to the interface circuit 624, such as via the bus 622. The mass storage device 630 may be or comprise a floppy disk drive, a hard disk drive, a compact disk (CD) drive, and/or digital versatile disk (DVD) drive, among other examples. The program code instructions 632 may be stored in the mass storage device 630, the volatile memory 618, the non-volatile memory 620, the local memory 614, and/or on a removable storage medium 634, such as a CD or DVD.

The mass storage device 630, the volatile memory 618, the non-volatile memory 620, the local memory 614, and/or the removable storage medium 634 may each be a tangible, non-transitory storage medium. The modules and/or other components of the processing system 600 may be implemented in accordance with hardware (such as in one or more integrated circuit chips, such as an ASIC), or may be implemented as software or firmware for execution by a processor. In the case of firmware or software, the implementation can be provided as a computer program product including a computer readable medium or storage structure containing computer program code (i.e., software or firmware) for execution by the processor.

The wellbore 104 penetrating one or more subterranean formations 102 and others described herein may be an open hole or cased hole, including implementations in which the cased hole has been perforated at the particular zone of interest.

In view of the entirety of the present disclosure, including the figures and the claims, a person having ordinary skill in the art will readily recognize that the present disclosure introduces an apparatus comprising an inflatable packer assembly for use in a wellbore penetrating a subterranean formation, comprising: a first fixed sleeve fixed to a mandrel; a first sliding sleeve moveable along the mandrel; a first inflatable member connected to the first fixed sleeve and the first sliding sleeve; a second sliding sleeve moveable along the mandrel; a second inflatable member connected to the first sliding sleeve and the second sliding sleeve; a second fixed sleeve fixed to the mandrel and slidably engaging the second sliding sleeve; an inflation flowline disposed within the mandrel and in fluid communication with interiors of the first and second inflatable members for inflating the first and second inflatable members to isolate a portion of the wellbore; and an injection flowline disposed within the mandrel for injecting a fluid into the isolated wellbore portion at a high enough pressure to create microfractures in the subterranean formation.

The first sliding sleeve may move along the mandrel in response to inflation and deflation of the first inflatable member, and the second sliding sleeve may move along the mandrel and the second fixed sleeve in response to inflation and deflation of the first and second inflatable members.

The inflation flowline and the injection flowline may form separate flowpaths.

The inflation flowline and the injection flowline may share a common flowpath. In such implementations, among others within the scope of the present disclosure, the inflatable packer assembly may further comprise a valve in fluid communication between the injection flowline and the isolated wellbore portion to control injecting the fluid into the isolated wellbore portion. The valve may be a relief having a set pressure of about 500 pounds per square inch.

The fluid may be injected into the isolated wellbore portion at about 12,000 pounds per square inch. In such implementations, among others within the scope of the present disclosure, the first and second inflatable members may be inflated to a pressure of about 1,000 pounds per square inch.

The present disclosure also introduces an apparatus comprising an inflatable packer assembly for use in a wellbore penetrating a subterranean formation, comprising: a first fixed sleeve fixed to a mandrel; a first sliding sleeve moveable along the mandrel; a first inflatable member connected to the first fixed sleeve and the first sliding sleeve; a second sliding sleeve moveable along the mandrel; a second inflatable member connected to the first sliding sleeve and the second sliding sleeve; a third sliding sleeve moveable along the mandrel; a third inflatable member connected to the second sliding sleeve and the third sliding sleeve; a second fixed sleeve fixed to the mandrel and slidably engaging the third sliding sleeve; a first inflation flowline disposed within the mandrel for inflating the first and third inflatable members to a first pressure; a second inflation flowline disposed within the mandrel for inflating the second inflatable member to a second pressure greater than the first pressure, wherein the inflated first, second, and third inflatable members isolate first and second portions of the wellbore; and an injection flowline disposed within the mandrel for injecting a fluid into at least one of the first and second isolated wellbore portions at a high enough pressure to enlarge microfractures in the subterranean formation.

The first sliding sleeve may move along the mandrel in response to inflation and deflation of the first inflatable member, the second sliding sleeve may move along the mandrel in response to inflation and deflation of the first and second inflatable members, and the third sliding sleeve may move along the mandrel and the second fixed sleeve in response to inflation and deflation of the first, second, and third inflatable members.

The second pressure may be sufficient to create the microfractures.

The injected fluid may pressurize the at least one of the first and second isolated wellbore portions to about 12,000 pounds per square inch. In such implementations, among others within the scope of the present disclosure, the first pressure may be about 1,000 pounds per square inch.

The present disclosure also introduces a method comprising: conveying an inflatable packer assembly (IPA) in a wellbore such that first and second inflatable members of the IPA straddle at least a portion of a zone of interest of a subterranean formation penetrated by the wellbore; inflating the first and second inflatable members to radially expand the first and second inflatable members into sealing engagement with a wall of the wellbore and thereby isolate a portion of the wellbore, wherein the first inflatable member extends between a fixed sleeve of the IPA and a first sliding sleeve of the IPA, and wherein the second inflatable member extends between the first sliding sleeve and a second sliding sleeve of the IPA, such that inflating the first and second inflatable members moves the first sliding sleeve closer to the fixed sleeve and moves the second sliding sleeve closer to the fixed sleeve and the first sliding sleeve; injecting fluid into the isolated wellbore portion through a port of the first sliding sleeve to create or enlarge micro fractures in the subterranean formation zone of interest; and after stopping the fluid injection, monitoring pressure in the isolated wellbore portion to determine a closing pressure of the microfractures.

Injecting the fluid may be to a pressure of at least about 12,000 pounds per square inch (psi). In such implementations, among others within the scope of the present disclosure, inflating the first and second inflatable members may be to a pressure of about 1,000 psi.

Inflating the first and second inflatable members to isolate a portion of the wellbore may comprise inflating the first and second inflatable members and a third inflatable member to isolate first and second portions of the wellbore. The third inflatable member may extend between the second sliding sleeve and a third sliding sleeve of the IPA, such that inflating the first, second, and third inflatable members may move the first sliding sleeve closer to the fixed sleeve, may move the second sliding sleeve closer to the fixed sleeve and the first sliding sleeve, and may move the third sliding sleeve closer to the fixed sleeve, the first sliding sleeve, and the second sliding sleeve. In such implementations, among others within the scope of the present disclosure, inflating the first, second, and third inflatable members may comprise: inflating the first and third inflatable members to a first pressure; and inflating the second inflatable member to a second pressure greater than the first pressure. The second pressure may be sufficient to create the microfractures, and injecting the fluid may enlarge the microfractures created by inflation of the second inflating member. Injecting the fluid may be to a pressure of at least about 12,000 pounds per square inch (psi), and the first pressure may be about 1,000 psi.

The foregoing outlines features of several embodiments so that a person having ordinary skill in the art may better understand the aspects of the present disclosure. A person having ordinary skill in the art should appreciate that they may readily use the present disclosure as a basis for designing or modifying other processes and structures for carrying out the same functions and/or achieving the same benefits of the embodiments introduced herein. A person having ordinary skill in the art should also realize that such equivalent constructions do not depart from the spirit and scope of the present disclosure, and that they may make various changes, substitutions and alterations herein without departing from the spirit and scope of the present disclosure.

The Abstract at the end of this disclosure is provided to comply with 37 C.F.R. § 1.72(b) to permit the reader to quickly ascertain the nature of the technical disclosure. It is submitted with the understanding that it will not be used to interpret or limit the scope or meaning of the claims.

What is claimed is:

1. An apparatus comprising:

an inflatable packer assembly for use in a wellbore penetrating a subterranean formation, comprising:

a first fixed sleeve fixed to a mandrel;

a first sliding sleeve moveable along the mandrel;

a first inflatable member connected to the first fixed sleeve and the first sliding sleeve;

a second sliding sleeve moveable along the mandrel;

a second inflatable member connected to the first sliding sleeve and the second sliding sleeve;

a second fixed sleeve fixed to the mandrel and slidably engaging the second sliding sleeve;

an inflation flowline disposed within the mandrel and in fluid communication with interiors of the first and second inflatable members for inflating the first and second inflatable members to isolate a portion of the wellbore; and an injection flowline disposed within the mandrel for injecting a fluid into the isolated wellbore portion at a high enough pressure to create microfractures in the subterranean formation.

2. The apparatus of claim 1 wherein the first sliding sleeve moves along the mandrel in response to inflation and deflation of the first inflatable member, and wherein the second sliding sleeve moves along the mandrel and the second fixed sleeve in response to inflation and deflation of the first and second inflatable members.

3. The apparatus of claim 1 wherein the inflation flowline and the injection flowline form separate flowpaths.

4. The apparatus of claim 1 wherein the inflation flowline and the injection flowline share a common flowpath.

5. The apparatus of claim 4 wherein the inflatable packer assembly further comprises a valve in fluid communication between the injection flowline and the isolated wellbore portion to control injecting the fluid into the isolated wellbore portion.

6. The apparatus of claim 5 wherein the valve is a relief having a set pressure of about 500 pounds per square inch.

7. The apparatus of claim 1 wherein the fluid is injected into the isolated wellbore portion at about 12,000 pounds per square inch.

8. The apparatus of claim 7 wherein the first and second inflatable members are inflated to a pressure of about 1,000 pounds per square inch.

9. An apparatus comprising:

an inflatable packer assembly for use in a wellbore penetrating a subterranean formation, comprising:

a first fixed sleeve fixed to a mandrel;

a first sliding sleeve moveable along the mandrel;

a first inflatable member connected to the first fixed sleeve and the first sliding sleeve;

a second sliding sleeve moveable along the mandrel;

a second inflatable member connected to the first sliding sleeve and the second sliding sleeve;

a third sliding sleeve moveable along the mandrel;

a third inflatable member connected to the second sliding sleeve and the third sliding sleeve;

a second fixed sleeve fixed to the mandrel and slidably engaging the third sliding sleeve;

a first inflation flowline disposed within the mandrel for inflating the first and third inflatable members to a first pressure;

a second inflation flowline disposed within the mandrel for inflating the second inflatable member to a second pressure greater than the first pressure, wherein the inflated first, second, and third inflatable members isolate first and second portions of the wellbore; and an injection flowline disposed within the mandrel for injecting a fluid into at least one of the first and second isolated wellbore portions at a high enough pressure to enlarge microfractures in the subterranean formation.

10. The apparatus of claim 9 wherein:

the first sliding sleeve moves along the mandrel in response to inflation and deflation of the first inflatable member;

the second sliding sleeve moves along the mandrel in response to inflation and deflation of the first and second inflatable members; and the third sliding sleeve moves along the mandrel and the second fixed sleeve in response to inflation and deflation of the first, second, and third inflatable members.

11. The apparatus of claim 9 wherein the second pressure is sufficient to create the microfractures.

12. The apparatus of claim 9 wherein the injected fluid pressurizes the at least one of the first and second isolated wellbore portions to about 12,000 pounds per square inch.

13. The apparatus of claim 12 wherein the first pressure is about 1,000 pounds per square inch.

14. A method comprising:

conveying an inflatable packer assembly (IPA) in a wellbore such that first and second inflatable members of the IPA straddle at least a portion of a zone of interest of a subterranean formation penetrated by the wellbore;

inflating the first and second inflatable members to radially expand the first and second inflatable members into sealing engagement with a wall of the wellbore and thereby isolate a portion of the wellbore, wherein the first inflatable member extends between a fixed sleeve of the IPA and a first sliding sleeve of the IPA, and wherein the second inflatable member extends between the first sliding sleeve and a second sliding sleeve of the IPA, such that inflating the first and second inflatable members moves the first sliding sleeve closer to the fixed sleeve and moves the second sliding sleeve closer to the fixed sleeve and the first sliding sleeve;

injecting fluid into the isolated wellbore portion through a port of the first sliding sleeve to create or enlarge microfractures in the subterranean formation zone of interest; and after stopping the fluid injection, monitoring pressure in the isolated wellbore portion to determine a closing pressure of the microfractures.

15. The method of claim 14 wherein injecting the fluid is to a pressure of at least about 12,000 pounds per square inch (psi).

16. The method of claim 15 wherein inflating the first and second inflatable members is to a pressure of about 1,000 psi.

17. The method of claim 14 wherein inflating the first and second inflatable members to isolate a portion of the wellbore comprises inflating the first and second inflatable members and a third inflatable member to isolate first and second portions of the wellbore, wherein the third inflatable member extends between the second sliding sleeve and a third sliding sleeve of the IPA, such that inflating the first, second, and third inflatable members moves the first sliding sleeve closer to the fixed sleeve, moves the second sliding sleeve closer to the fixed sleeve and the first sliding sleeve, and moves the third sliding sleeve closer to the fixed sleeve, the first sliding sleeve, and the second sliding sleeve.

18. The method of claim 17 wherein inflating the first, second, and third inflatable members comprises:

inflating the first and third inflatable members to a first pressure; and inflating the second inflatable member to a second pressure greater than the first pressure.

19. The method of claim 18 wherein the second pressure is sufficient to create the microfractures, and wherein injecting the fluid enlarges the microfractures created by inflation of the second inflating member.

20. The method of claim 18 wherein injecting the fluid is to a pressure of at least about 12,000 pounds per square inch (psi), and wherein the first pressure is about 1,000 psi.

* * * * *